US010640956B2

(12) United States Patent
Kennedy

(10) Patent No.: US 10,640,956 B2
(45) Date of Patent: May 5, 2020

(54) ADJUSTABLE DRAIN VALVE FOR DRY BARREL FIRE HYDRANT

(71) Applicant: Kennedy Valve Company, Elmira, NY (US)

(72) Inventor: Paul Kennedy, Horseheads, NY (US)

(73) Assignee: Kennedy Valve Company, Elmira, NY (US)

( * ) Notice: Subject to any disclaimer, the term of this patent is extended or adjusted under 35 U.S.C. 154(b) by 0 days.

(21) Appl. No.: 15/934,255

(22) Filed: Mar. 23, 2018

(65) Prior Publication Data

US 2019/0292755 A1 Sep. 26, 2019

(51) Int. Cl.

| | |
|---|---|
| ***E03B 9/14*** | (2006.01) |
| ***A62C 35/20*** | (2006.01) |
| ***E03B 9/04*** | (2006.01) |
| ***A62C 35/68*** | (2006.01) |

(52) U.S. Cl.

CPC ..... *E03B 9/14* (2013.01); *A62C 35/20* (2013.01); *A62C 35/68* (2013.01); *E03B 9/04* (2013.01); *Y10T 137/5497* (2015.04)

(58) Field of Classification Search

CPC ..... E03B 9/14; E03B 9/02; Y10T 137/5456; Y10T 137/5532; Y10T 137/5497; A62C 35/68; A62C 35/20

See application file for complete search history.

(56) References Cited

U.S. PATENT DOCUMENTS

| | | | | |
|---|---|---|---|---|
| 1,349,062 | A * | 8/1920 | Goldberg | E03B 9/04 137/283 |
| 3,599,662 | A * | 8/1971 | Dashner | E03B 9/14 137/257 |
| 5,433,410 | A * | 7/1995 | Foltz | F01M 11/0408 251/100 |
| 6,561,214 | B2 * | 5/2003 | Heil | E03B 9/14 137/302 |
| 9,260,841 | B2 * | 2/2016 | Kennedy | E03B 9/08 |
| 2007/0044838 | A1 * | 3/2007 | Ball | E03B 9/14 137/285 |

* cited by examiner

*Primary Examiner* — Kevin L Lee
(74) *Attorney, Agent, or Firm* — Brown & Michaels, PC

(57) ABSTRACT

A drain valve to drain water from a dry barrel hydrant includes a drain valve body fixed to a main valve assembly of the hydrant, and a hollow drain hole sleeve positioned in a drain hole of an elbow of the hydrant. The drain valve body includes a drain valve facing configured to align with the drain hole of the elbow as a result of the main valve assembly being in an open position, and to not align with the drain hole of the elbow as a result of the main valve assembly being in a closed position. In another embodiment, an elbow of a fire hydrant includes a hollow body, an upper end defining a drain hole to allow water to drain out, and a hollow drain hole sleeve in the drain hole.

18 Claims, 12 Drawing Sheets

ADJUSTABLE DRAIN VALVE FOR DRY BARREL FIRE HYDRANT

BACKGROUND OF THE INVENTION

Field of the Invention

The invention pertains to the field of fire hydrants. More particularly, the invention pertains to dry barrel fire hydrant drain valves.

Fire hydrants were first invented in the early 1800's and followed the wide spread adoption of municipal water lines. By 1858, the cast iron dry-barrel hydrant was developed and became a ubiquitous curb-side fixture in urban areas throughout the US and much of the rest of the world, providing high pressure water at high volumes on nearly every city street.

The dry-barrel hydrant is particularly well suited to colder climates where low temperatures can freeze water in a hydrant and block the flow of water to the hydrant's outlets. Referring to the prior art FIG. 1, the dry-barrel hydrant is constructed in three major assemblies. An upper barrel 10, generally made of cast iron, is located above ground level and provided with outlet ports 40 for attachment of fire hoses. A barrel cap 50 at the top of the upper barrel 10 houses an operating stem nut 60 which can be turned to open or close the flow of water into the hydrant. This configuration defined the "fire plug" design which has since become almost universally recognizable.

The upper barrel 10 is connected to one end of a lower barrel 20 via a mating flange 70, 71, generally of a break-away design such that the upper barrel 10 can separate from the lower barrel 20 cleanly at the mating flange 70, 71, for example, if struck by an automobile. The lower barrel 20 provides a conduit through which water can flow from a location below the frost line, to the upper barrel 10 where it is needed for subsequent use in firefighting. The other end of the lower barrel 20 is similarly connected via a mating flange 80, 81 to an elbow 32 containing the hydrant's main valve assembly 30. The elbow 32 and main valve assembly 30 are shown in greater detail in prior art FIG. 2. The elbow 32 is also connected to a water main via an intervening gate valve (not shown) that can isolate the hydrant from the water main during installation, repair, or replacement of the hydrant. In this embodiment, a flange 34 is provided on one side of the elbow 32 for this purpose.

The operating stem nut 60 in the barrel cap 50 is threaded to a first end of an operating stem 12 (including a breaking coupling 24, and operating stem extension 22), which traverses inside the upper barrel 10 and the lower barrel 20, and which is connected to the main valve assembly 30 inside the elbow 32 at a second end opposite the first end. Turning the operating stem nut 60, in turn, raises and lowers the operating stem 12 (and breaking coupling 24, and operating stem extension 22) and thus the main valve assembly 30 against, or away from, as shown for example in prior art FIG. 2, a main valve seat 33 located in the elbow 32 below a mating flange 80, 81 coupling the lower barrel 20 to the elbow 32. Thus, the elbow 32 has a "wet" side, below the main valve seal 36 inside the elbow 32, and a "dry" side above the main valve seal 36 and main valve seat 33.

The main advantage of this type of valve is that all main valve parts that are in contact with water, separating the "wet" and "dry" sides of the main valve seal 36, are located below the frost line, and therefore are protected from freezing, and seizing, in cold temperatures, thus ensuring a reliable supply of water regardless of climate conditions.

As shown in prior art FIG. 2, drain holes 37 located in the elbow 32 and a valve seat insert 31 inset in the elbow 32, above the level of the main valve seal 36, allow the upper barrel 10 and lower barrel 20 to drain water to surrounding gravel beds or concrete basins once the hydrant main valve seal 36 has been closed against the main valve seat 33 after use. Hence, the term "dry barrel" hydrant is applied, as no water is present in the hydrant upper 10 and lower 20 barrels when the main valve seal 36 in the elbow 32 is closed.

As shown in prior art FIGS. 2-3, the main valve seal 36 is disposed between a main valve bottom plate 35 below the main valve seal 36, and a drain valve body 39 above the main valve seal 36. The operating stem extension 22 passes through the drain valve body 39, the main valve seal 36, and is threaded into the main valve bottom plate 35. Once assembled, drain valve pin 22A (prior art FIG. 3) inserted through the drain valve body 39 and the operating stem extension 22 prevents rotation of the operating stem extension 22 relative to the main valve bottom plate 35 during operation.

As shown in prior art FIGS. 2-3, the drain holes 37 are open to the inner volume of water above the main valve seal 36 when the main valve seal 36 is closed against the valve seat 33, and the upper barrel 10 and lower barrel 20 are allowed to drain (see arrows in prior art FIGS. 2-3). The drain valve body 39 is also provided with a drain valve facing 38, and a spring 38A which biases the drain valve facing 38 to move outwardly toward the valve seat 33. When the main valve seal 36 is opened by downward movement of the operating stem extension 22, the drain valve body 39 also moves downwardly such that the drain valve facing 38 is moved over the drain holes 37 in the elbow 32. The drain valve facing 38 is then held against the drain holes 37 through the spring 38A bias and high pressure water flowing past the main valve 36, effectively blocking the flow of water out of the drain holes 37 in the elbow 32.

SUMMARY OF THE INVENTION

In an embodiment, a drain valve is provided to drain water from a dry barrel hydrant, the dry barrel hydrant including a barrel coupled to an upper end of an elbow having a hollow body, and a main valve assembly configured to seal against a seat located below a drain hole in the upper end of the elbow, the main valve assembly moving from an open position allowing water to flow from the elbow into the barrel to a closed position in which the main valve assembly seals against the seat, blocking water flow from the elbow into the barrel. The drain valve includes a drain valve body fixed to a main valve assembly of the hydrant, and a hollow drain hole sleeve positioned in a drain hole of an elbow of the hydrant. The drain valve body includes a drain valve facing configured to align with the drain hole of the elbow as a result of the main valve assembly being in an open position, and to not align with the drain hole of the elbow as a result of the main valve assembly being in a closed position.

In another embodiment, an elbow of a fire hydrant includes a hollow body, an upper end defining a drain hole to allow water to drain out, and a hollow drain hole sleeve in the drain hole.

DETAILED DESCRIPTION OF THE INVENTION

Figure 1:
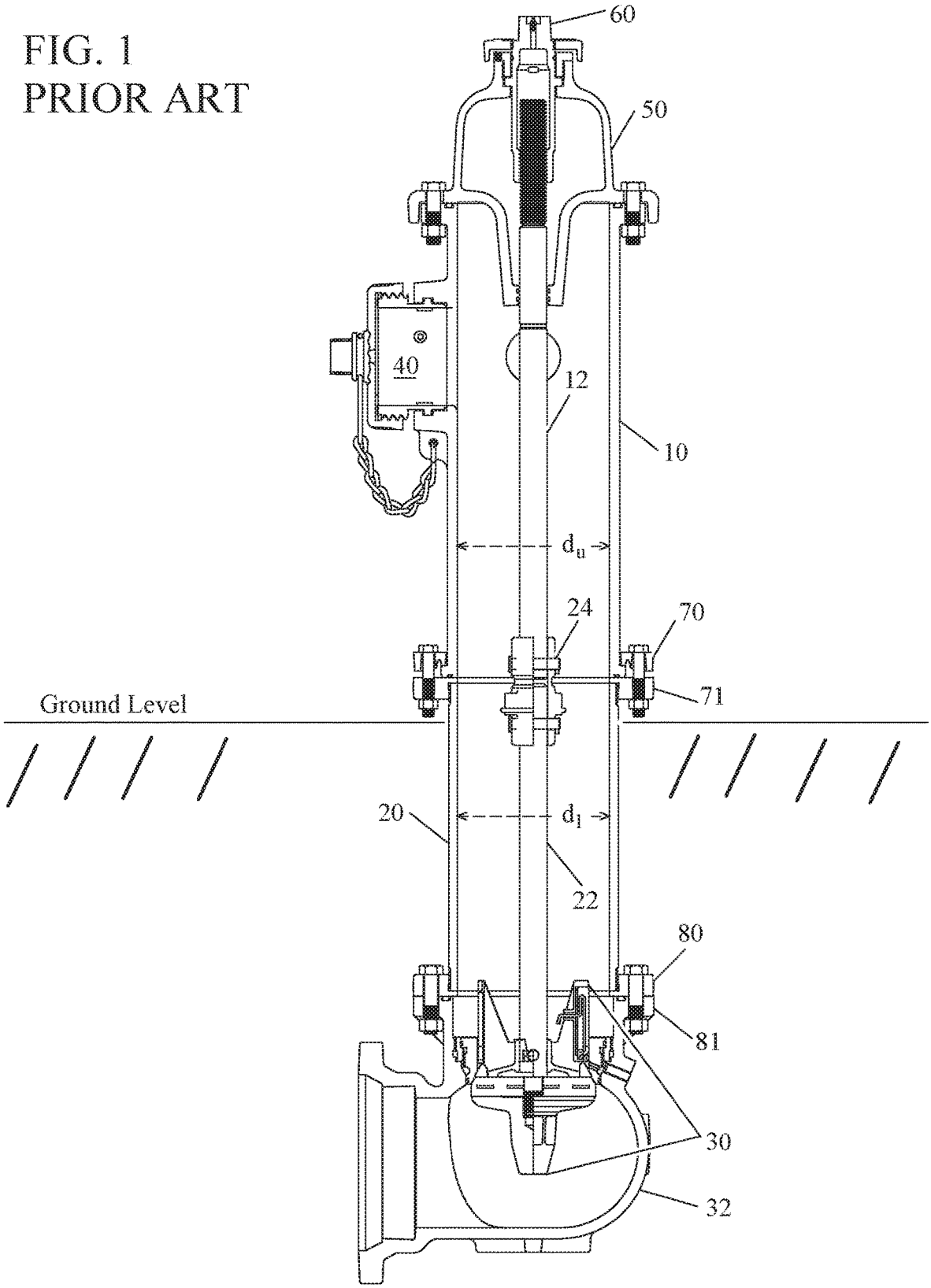
FIG. 1 PRIOR ART
FIG. 1 shows a prior art hydrant with an upper barrel, a lower barrel, elbow, and main valve assembly.
Figure 2:
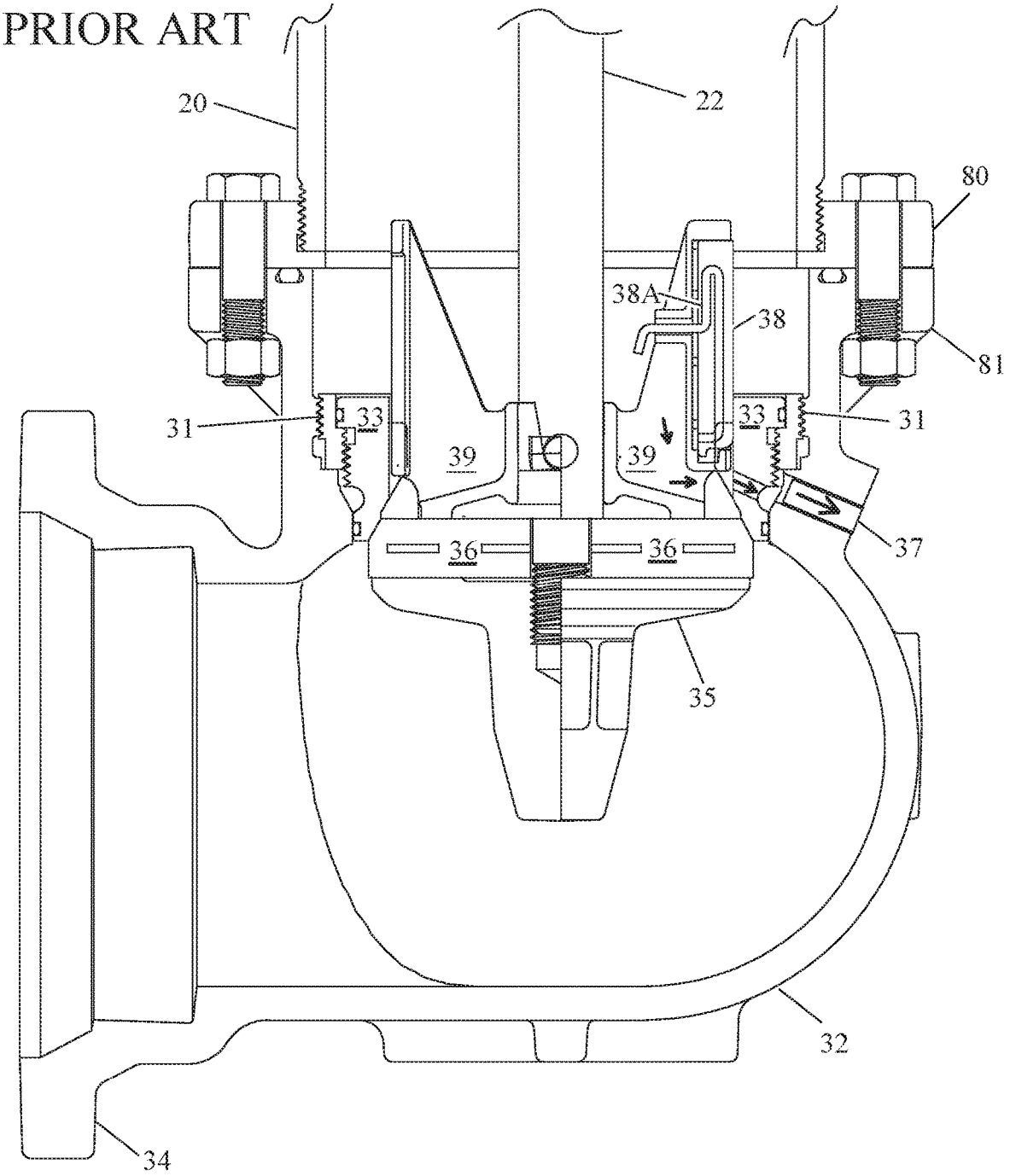
FIG. 2 PRIOR ART
FIG. 2 shows a prior art elbow and main valve assembly.

In the following description, reference is made to the accompanying drawings that form a part thereof, and in which is shown by way of illustration specific example embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

The terminology used herein is for the purpose of describing particular example embodiments only and is not intended to be limiting. As used herein, the singular forms "a", "an", and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

A hydrant elbow and adjustable drain valve simplify manufacturing and reduce manufacturing costs, for example, by simplifying a drain valve body design (e.g., by eliminating a spring biasing the drain valve facing toward the elbow drain hole), and lessening the precision with which the drain valve body is fitted to seal against the elbow drain hole.

Figure 3:
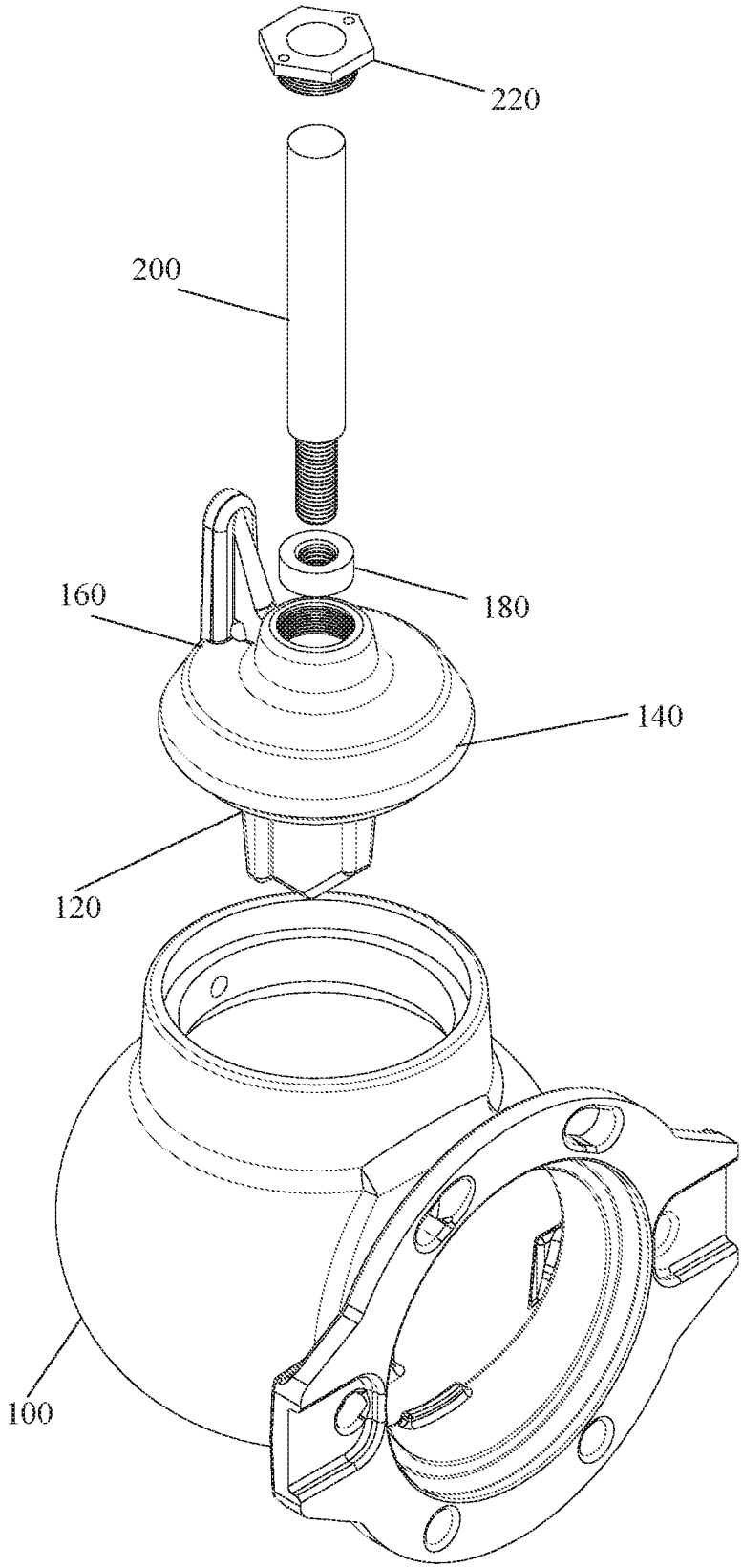
FIG. 3 shows a perspective view of an improved elbow and main valve assembly.

An embodiment of an elbow 100 and main valve components are shown in perspective in FIG. 3, including a main valve bottom plate 120, a main valve seal 140, a drain valve body 160, a thrust bearing 180, an operating stem extension 200, and a retaining nut 220. The assembly and operational relationship of this main valve embodiment and its elements are shown in cross-section in FIGS. 4-8. Identical reference numbers are used in all figures to indicate identical elements.

The main valve seal 140 can be formed from an elastomeric material that can be compressed, or alternatively stretched in tension, between the main valve bottom plate 120 and the drain valve body 160, which are coupled to the operating stem extension 200 such that the drain valve body 160 and the operating stem extension 200 can move relative to each other when the operating stem extension 200 is rotated. Compression, or stretching under tension, of the main valve seal 140 changes an outer diameter of the main valve seal so that the main valve seal 140 can be inserted and removed from the elbow 100 without the need for removable valve seats or valve seat inserts.

Figure 4:
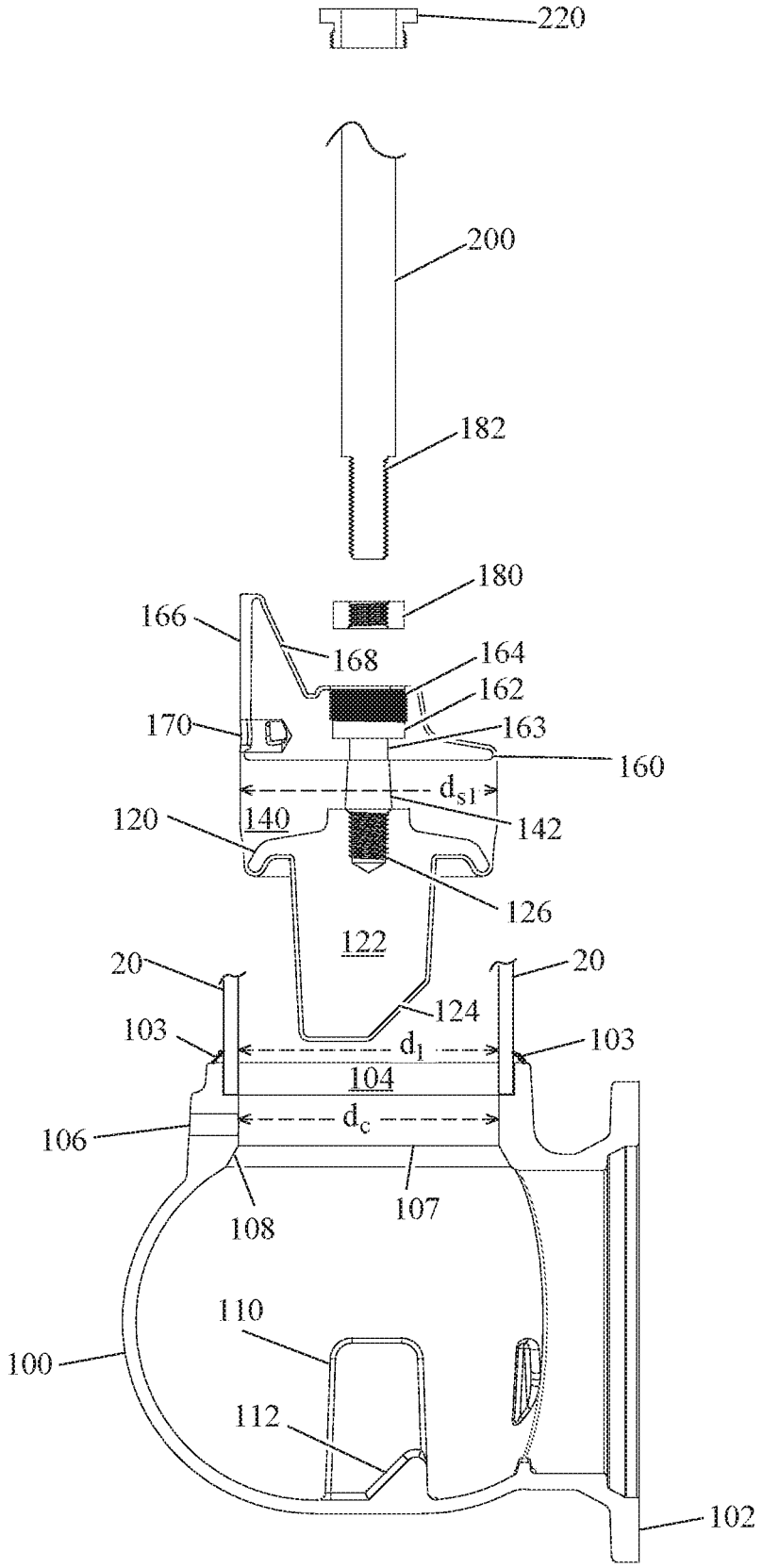
FIG. 4 shows a cross sectional view of an elbow, and components of a main valve assembly.

Referring now to FIG. 4, the elbow 100 can be constructed with a flange 102 for connection to a water main in the conventional manner. While the elbow 100 can also be constructed with a flange for connection to a lower barrel 20, in some embodiments a socket 104 for receiving the lower barrel 20 is formed at the top of the elbow 100. The socket 104 can be provided with internal threads 105 (see FIG. 9) that mate with threads on one end of the lower barrel 20, or the socket 104 can be unthreaded such that one end of the lower barrel 20 can be inserted into the socket 104 and then secured by welding 103 about the circumference of the junction thus formed.

A channel 107 at the top of the elbow 100 can be provided for water to flow out of the elbow 100 and into the lower barrel 20. The lower end of the channel 107 can be chamfered about its circumference, forming a main valve seat 108 inside the elbow 100 below the channel 107. The socket 104, channel 107, and valve seat 108 can all be formed as an integral part of the elbow 100 using conventional casting techniques known in the art. If necessary, the socket 104, channel 107, and main valve seat 108 can be worked further, dimensioned, and polished also using techniques known in the art such as CNC multi-axis milling equipment. An elbow drain hole 106 can also be provided in the elbow 100 communicating through the elbow 100 to the channel 107. The elbow drain hole 106 can also be formed during casting and/or with reworking techniques known in the art.

The construction of the socket 104, channel 107, and main valve seat 108 described herein make one advantage of the improved main valve over the prior art readily apparent. No separate main valve seat inserts or valve seat rings are used. Hence, the diameter, $d_c$, of the channel 107 can be matched to the internal diameter, $d_l$, of the lower barrel 20 (and upper barrel 10 diameter, $d_u$, shown in FIG. 1) for improved hydraulic efficiency.

At the bottom of the elbow 100, two parallel plates 110 (only one plate is shown in this cross-section) can extend vertically upward inside the elbow 100. The space between the plates can be substantially open and aligned with a plane that coincides with the location of the elbow drain hole 106 in the channel 107. A wedge 112 can also be formed between the parallel plates 110 at their lower extent, and positioned at the side of the plates 100 which is farthest from the drain hole 106. The plates 110 and wedge 112 thus form a guide in the bottom of the elbow 100. This guide can be formed as an integral portion of the elbow 100 casting as a surface of the elbow 100, or can be constructed separately and affixed, for example by welding, to the desired location in the elbow 100 after it has been cast.

The main valve bottom plate 120 can be substantially formed as a disk with a diameter less than $d_c$, and of sufficient thickness to provide for a threaded hole 126 through the main valve bottom plate 120 at a center of the main valve bottom plate 120. A blade 122 can also extend vertically down from the lower surface of the main valve bottom plate 120. The blade 122 can have a thickness approximately equal to the spacing between the parallel plates 110 at the bottom of the elbow 100 so that the blade can freely move into and out of the guide formed by the parallel plates 100 and the wedge 112.

The blade geometry and configuration can vary, and is shown in FIG. 4 as a substantially rectangular structure that has had one corner removed, forming a wedge with an angled side 124 at the bottom of the blade 122. Other geometries can be used, provided the blade 122 is capable of mating with the guide formed by the parallel plates 110 and wedge 112 at the bottom of the elbow. The blade 122 engages with the parallel plates 110 to limit or prevent rotation of the blade 122 and the main valve bottom plate 120 relative to the elbow 100.

The drain valve body 160 can also be substantially formed as a disk with an outer diameter less than $d_c$. An aperture through the center of the drain valve body 160 can have a threaded portion 164 at the top of the aperture, an unthreaded portion 162 in the middle of the aperture, and a smaller diameter unthreaded portion 163 at the bottom of the aperture. The drain valve body 160 can further include a drain valve slide 168 extending vertically upward from the upper surface of the drain valve body 160, and substantially along a radius of the disk shaped drain valve body 160.

In an embodiment, shown in FIG. 4, the main valve seal 140 can be molded in a first, relaxed or non-deformed state with a cross-section and an outer diameter, $d_{sl}$, as a substantially annular cylinder with a central passage 142. The main valve seal 140 outer diameter, $d_{sl}$, can be slightly smaller than the diameter, $d_l$, of the lower barrel 20 and the diameter, $d_c$, of the channel 107 (and the diameter, $d_u$, of the upper barrel 10, shown in FIG. 1). Thus, when assembled, the drain valve body 160, the main valve seal 140, and the main valve bottom plate 120 can pass through the upper barrel 10, the lower barrel 20, and the channel 107.

During manufacture, a bonding agent (such as an adhesive) can be applied to the outer surfaces of the drain valve body 160 and the main valve bottom plate 120. The drain valve body 160 and the main valve bottom plate 120 can then be placed in a mold and held in an orientation such that the plane of the main valve bottom plate 120 blade 122 is held in the same plane as a drain valve port 170 of the drain valve body 160.

In an embodiment, the mold is constructed such that a small space remains open between the inside surface of the mold and the external surfaces of the drain valve body 160 and main valve bottom plate 120. The mold also maintains a separation between the top of the main valve bottom plate 120 and the bottom of the drain valve body 160 a distance that will determine the thickness of the main valve seal 140 after molding. Mold inserts known in the art can be used to plug elements to be protected during the molding process, such as the drain valve port 170, the aperture 162, 163, 164 through the drain valve body 160, and the threaded hole 126 in the top of the main valve bottom plate 120.

The mold can then be filled with an elastomer that will form the main valve seal 140, and also coat the outer surfaces of the drain valve body 160 and main valve bottom plate 120. In one preferred embodiment, the mold can be filled with ethylene propylene diene monomer rubber (EPDM), however other elastomer materials such as styrene-butadiene (SBR), nitrile rubber, or neoprene rubber, for example, can also be used. The contents of the mold can then be cured, forming the main valve seal 140 and a continuous elastomer coating 121 (see FIG. 5) around the drain valve body 160 and main valve bottom plate 120, as well as a drain valve facing 166 and the drain valve port 170. In other embodiments, the mold can be matched to the shape of the drain valve body 160 and the main valve bottom plate 120 such that only the main valve seal 140 and the drain valve facing 166 are bonded to the drain valve body 160 and the main valve bottom plate 120.

Prior application of a bonding agent to the drain valve body 160 and the main valve bottom plate 120 and curing creates a rubber tearing bond between the drain valve body 160 and the main valve seal 140, the main valve seal 140 and the main valve bottom plate 120, and the elastomer coating 121 the drain valve body 160 and the main valve bottom plate 120 on their outer surfaces.

A "rubber tearing bond" is defined as an engineering bond, generally between metal and rubber (an elastomer), that will cause a failure in the rubber (elastomer) when exposed to destructive testing before a failure in the bond between the metal and rubber (elastomer) will occur. Coating 121 of the drain valve body 160, and particularly the drain valve slide 168, can also create a drain valve facing 166 that similarly includes an elastomer layer bonded to the drain valve slide 168 with a rubber tearing bond.

Figure 5:
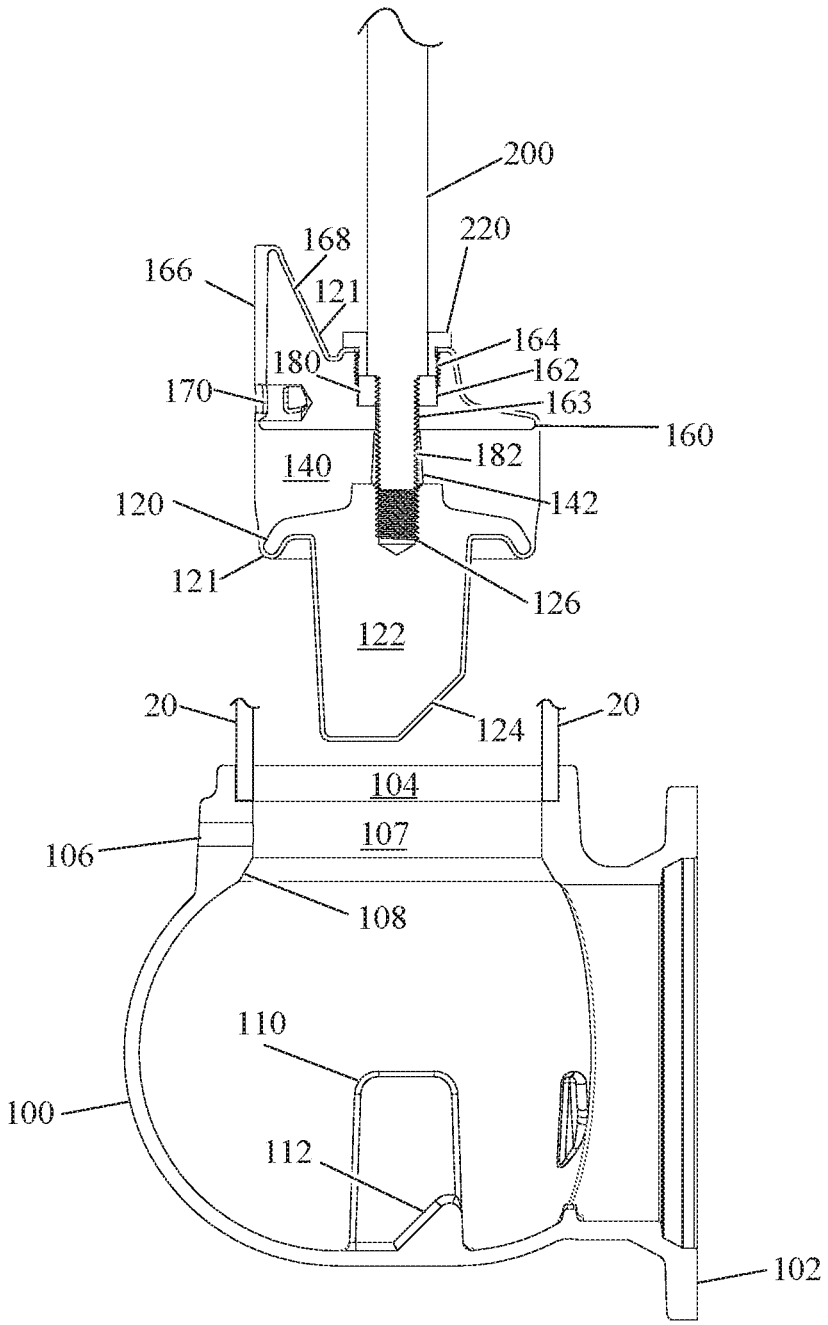
FIG. 5 shows a main valve bottom plate, main valve seal, drain valve body, and operating stem extension assembled prior to installation in an elbow.

Referring to FIG. 5, prior to insertion into the elbow 100, the thrust bearing 180 can be threaded onto a first end 182 of the operating stem extension 200 such that an unthreaded portion of the operating stem extension 200 is above the thrust bearing 180, and the remaining threaded first end 182 of the operating stem extension 200 protrudes below the thrust bearing 180. The threaded end 182 of the operating stem extension 200, can then be inserted through the aperture sections 162, 163, 164 in the drain valve body 160.

The threaded first end 182 of the operating stem extension 200 passes through the central passage 142 in the main valve seal 140, and is threaded into the hole 126 in main valve bottom plate 120 until the thrust bearing 180 is received within aperture section 162 in the drain valve body 160, and blocked by the smaller diameter aperture section 163. A retaining nut 220 can be slid over the operating stem extension 200 and threaded into the aperture section 164 to hold the drain valve body 160 in a fixed longitudinal position on the operating stem extension 200 while allowing the operating stem extension 200 to rotate until the retaining nut 220 is fully tightened.

Thus, the thrust bearing 180 residing in the aperture section 162 couples the drain valve body 160 to the operating stem extension 200 such that the operating stem extension 200 can rotate relative to the drain valve body 160, and the position of the drain valve body 160 longitudinally on the operating stem extension 200 is fixed since the thrust bearing 180 is prevented from moving through the drain valve body 160 by the smaller lower aperture section 163 on the one side and the retaining nut 220 on the other side. Similarly, the operating stem extension 200 is coupled to the main valve bottom plate 120 by the threaded end 182 of the operating stem extension 200 mating with the threaded hole 126 of the main valve bottom plate. This coupling allows the main valve bottom plate 120 to move longitudinally along the operating stem extension 200 when the operating stem extension 200 is rotated.

Figure 6:
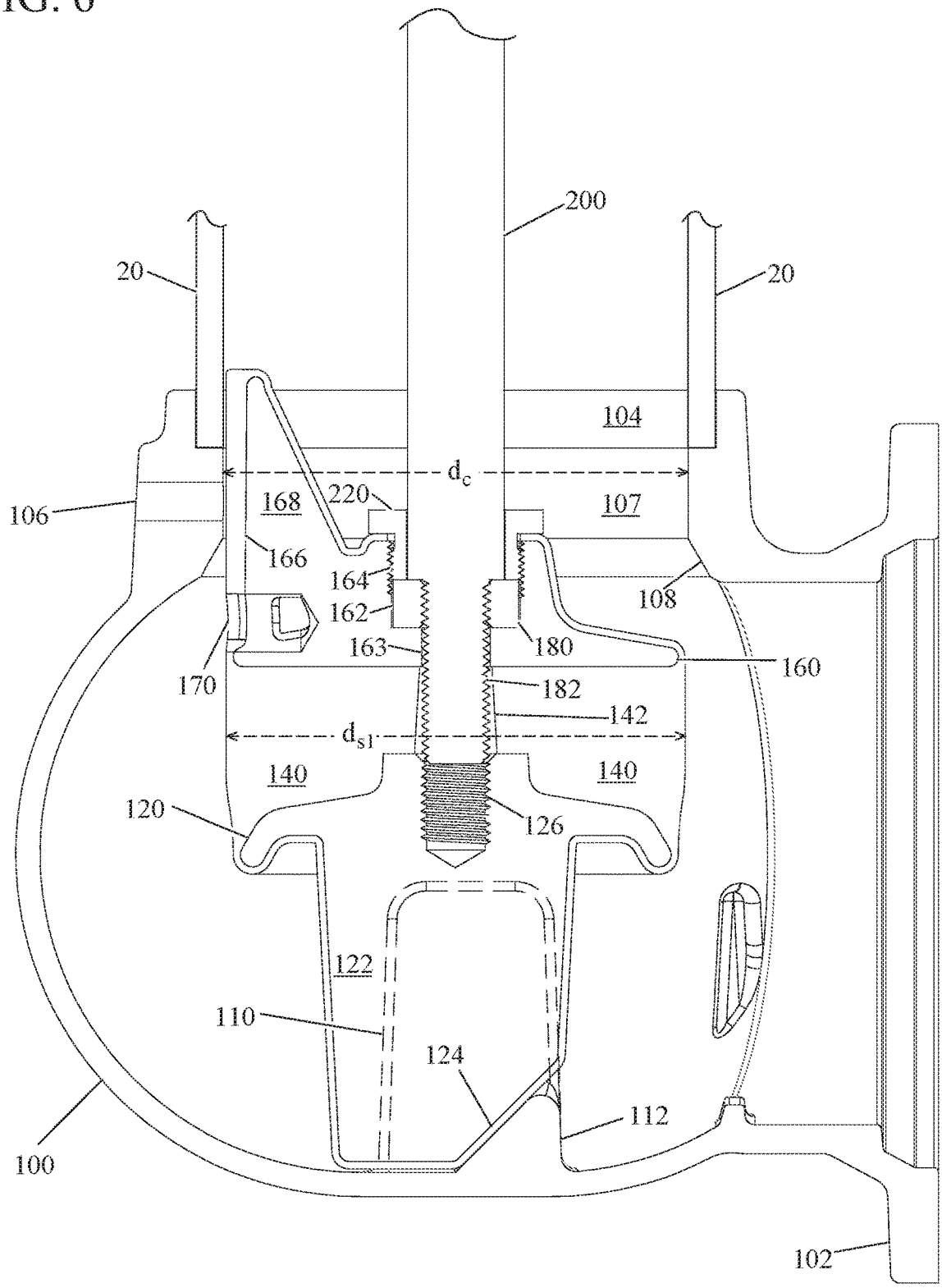
FIG. 6 shows a main valve bottom plate, main valve seal, drain valve body, and operating stem extension after being inserted in an elbow.

Referring now to FIG. 6, as the assembled drain valve body 160, main valve seal 140, and main valve bottom plate 120 have a diameter, $d_{sl}$, that is slightly less than the diameter, $d_c$, of the elbow 100 channel 107, the entire assembly can be inserted into the elbow 100 from above through the upper barrel 10 (not shown in this figure), lower barrel 20, and channel 107. When properly inserted, the main valve bottom plate 120 blade 122 rests within the guide formed by the two parallel plates 110 (dashed lines in FIG. 6) at the bottom of the elbow 100. The plates 110, acting as a rotation block, thus prevent the blade 122, acting as a rotation lock, and main valve bottom plate 120 from rotating when the operating stem extension 200 is turned (via the operating stem 12 and breaking coupling 24 shown in FIG. 9).

Figure 7:
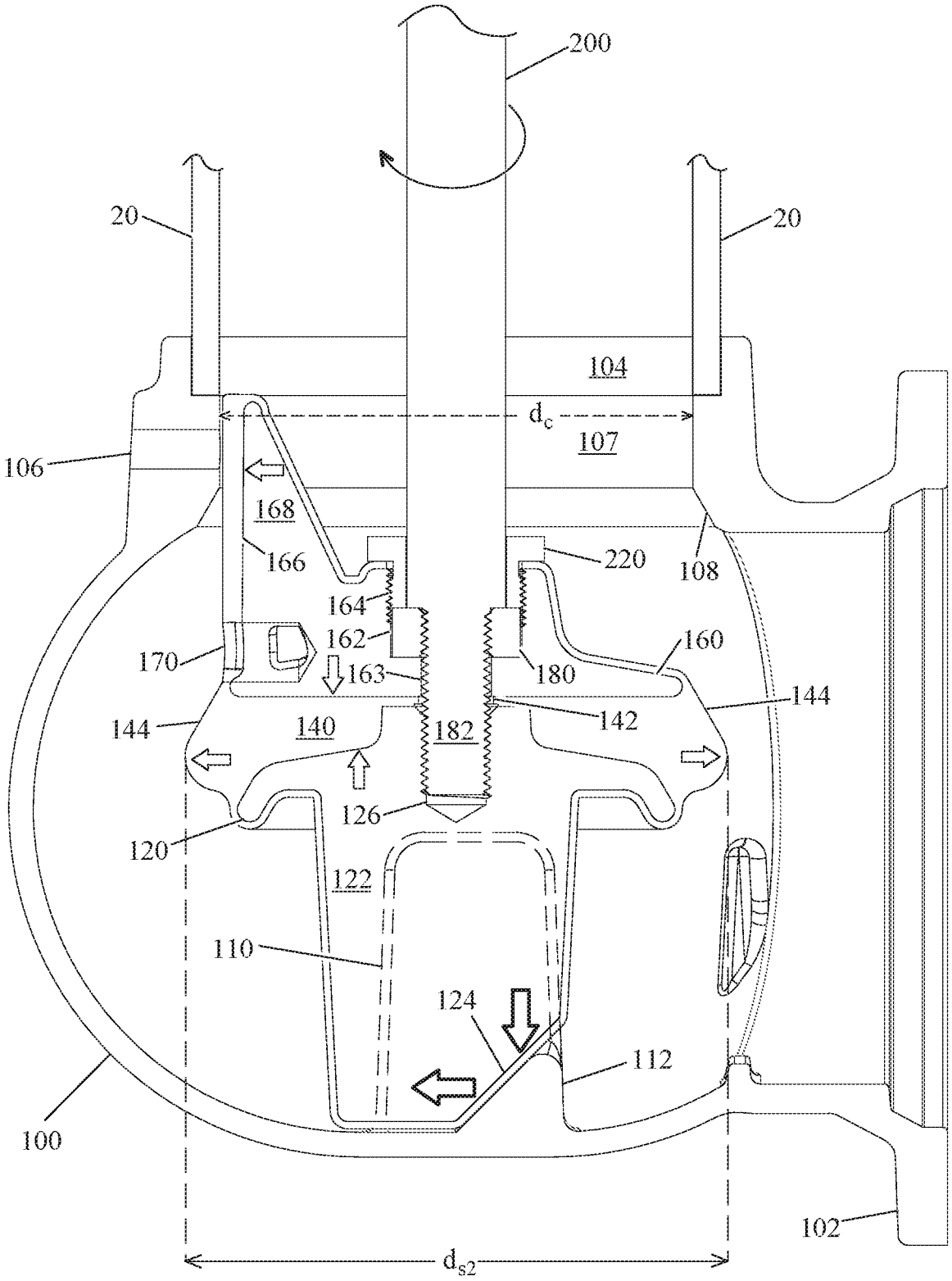
FIG. 7 shows a main valve bottom plate and drain valve body compressing a main valve seal by rotation of an operating stem extension after insertion in an elbow.

FIG. 7 illustrates the compression of the main valve seal 140 into a second state with a second cross-sectional profile and a second diameter, $d_{s2}$, that is larger than the channel 107 diameter, $d_c$. The plates 110 and blade 122 (a rotation block and a rotation lock, respectively) prevent the main valve bottom plate 120 from rotating, which in turn prevents the main valve seal 140 and drain valve body 160 from rotating as their bonding to each other and the main valve bottom plate 120 rotationally couples the three elements. The operating stem extension 200 can then be rotated to move the threaded end 182 of the operating stem extension 200 further into the hole 126 in the main valve bottom plate 120.

The thrust bearing 180 in turn forces the drain valve body 160 and the main valve bottom plate 120 to move closer to each other on the operating stem extension 200. In the process, the elastomeric main valve seal 140 elastically deforms and can be forced outwardly from the space between the two. The material thus forced out from between the main valve bottom plate 120 and drain valve body 160 at their perimeter forms a main valve seal 140 with a diameter, $d_{s2}$, that is larger than the channel 107 diameter, $d_c$, and provides a mating surface 144 for the valve seat 108 when the main valve is closed.

For the purposes of this description, "elastic deformation" is understood to be a reversible change in the dimensions of a material, in which the material has a first set of dimensions when no forces are applied to it, the material transitions to a second set of dimensions when forces are applied to it, and transitions back to its original set of dimensions when the forces are no longer applied. Such deformation includes but is not limited to changes in spatial dimensions and combinations thereof (e.g., changes in volume, cross-sectional profile, and diameter), and can result from forces including, but not limited to, forces of compression and/or stretching under tension.

Having compressed the main valve seal 140 into its second state operational diameter, $d_{s2}$, and second state profile, the retaining nut 220 can be tightened from above, using for example an "L" shaped wrench with an extended handle, locking the thrust bearing 180 and operating stem extension 200 into the drain valve body 160 such that the operating stem 200 can not rotate and loosen the connection between the main valve bottom plate 120 and drain valve body 160 during normal operation of the main valve.

Figure 8:
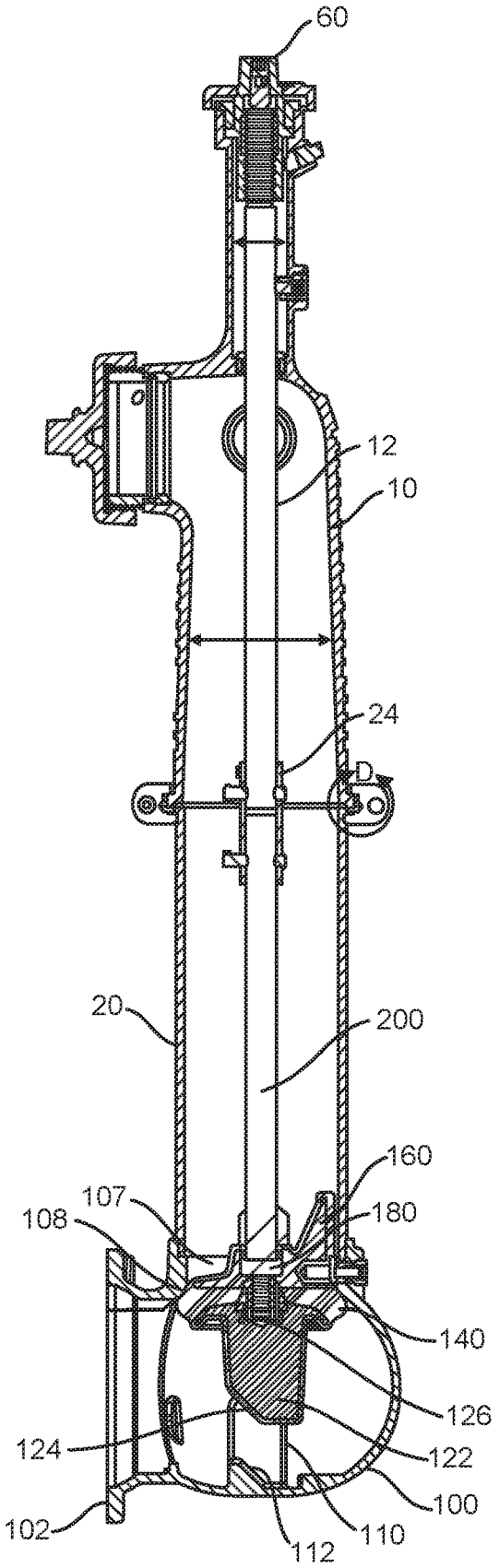
FIG. 8 shows a main valve bottom plate, main valve seal, and drain valve body positioned against a valve seat in an elbow closing the main valve and opening a drain hole valve.

As shown in FIG. 8, the operating stem nut 60, can next be assembled to the upper barrel 10 and the operating stem extension 200 (including the operating stem 12 and the breaking coupling 24).

Figure 9:
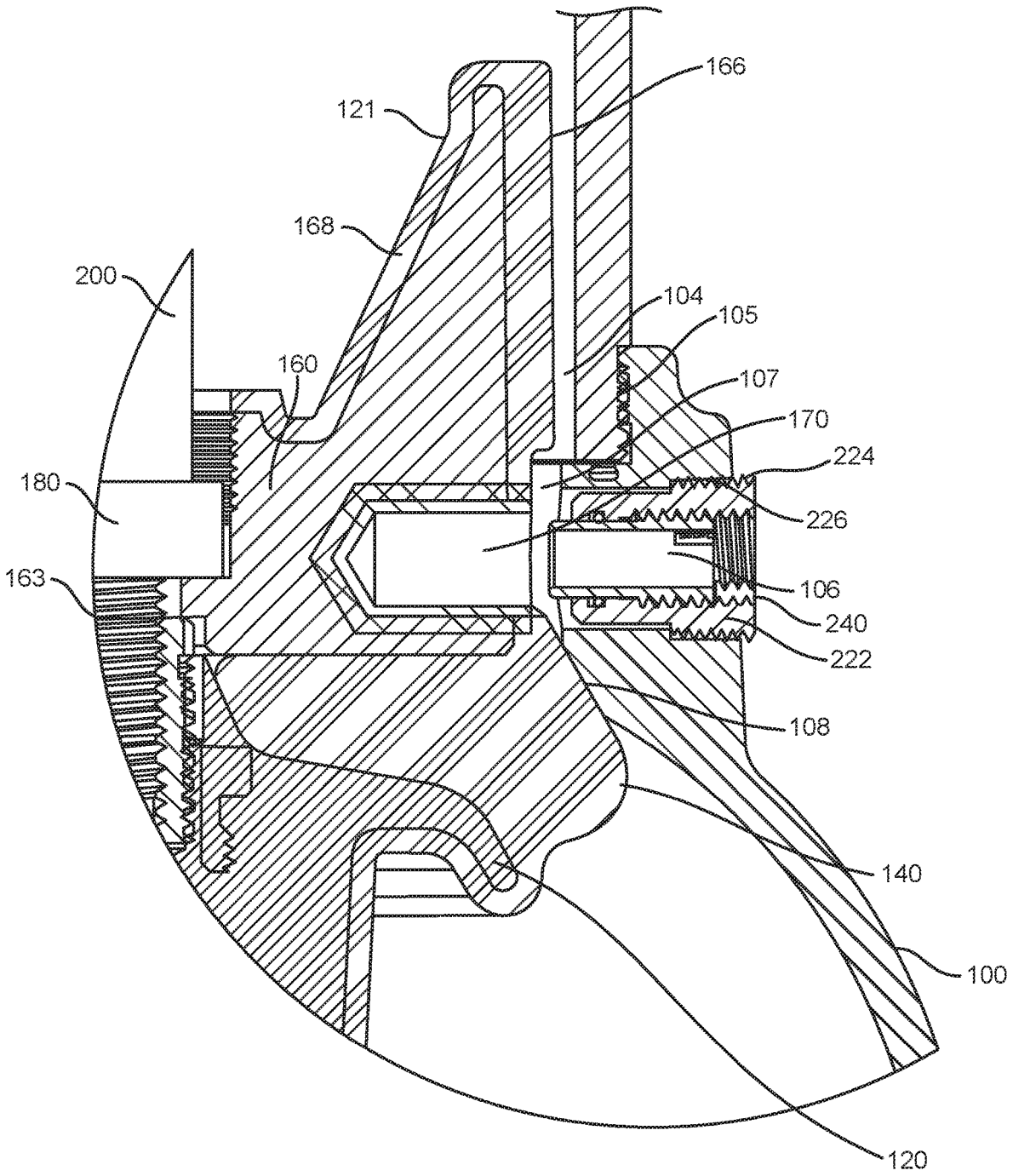
FIG. 9 shows an enlarged view of the closed main valve and opened drain hold valve in an enlarged view.

Also shown in FIG. 8, and in enlarged detail in FIG. 9, the elbow drain hole 106 (not labeled in FIG. 8) can be equipped with a drain hole bushing 222 and a hollow drain hole sleeve 240 to facilitate adjustment of the drain hole and lessen the required level of precision in manufacturing tolerance. For example, the drain valve body 160 can be manufactured with relatively low precision of tolerancing, and the drain hole sleeve 240, after assembly, can be adjusted to seal against the drain valve facing 166. As time wears on, if the internal parts shift, the drain hole sleeve 240 can again be easily adjusted from outside the elbow 100 to maintain a proper seal of the elbow drain hole 106.

Figure 10:
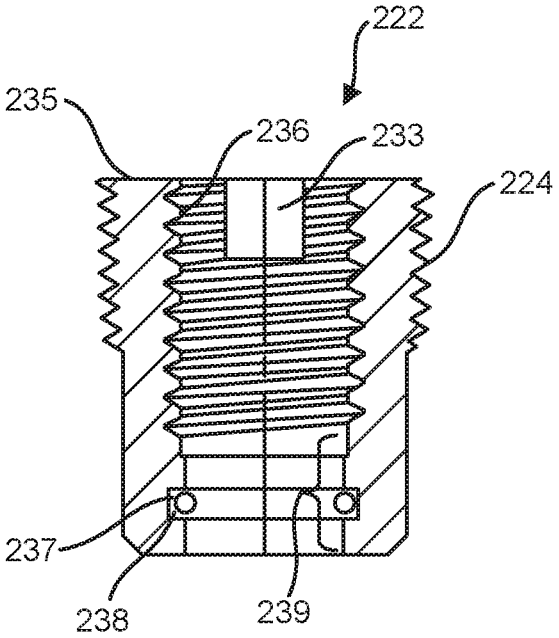
FIG. 10 shows a side view of the drain hole bushing, according to an embodiment.
Figure 11:
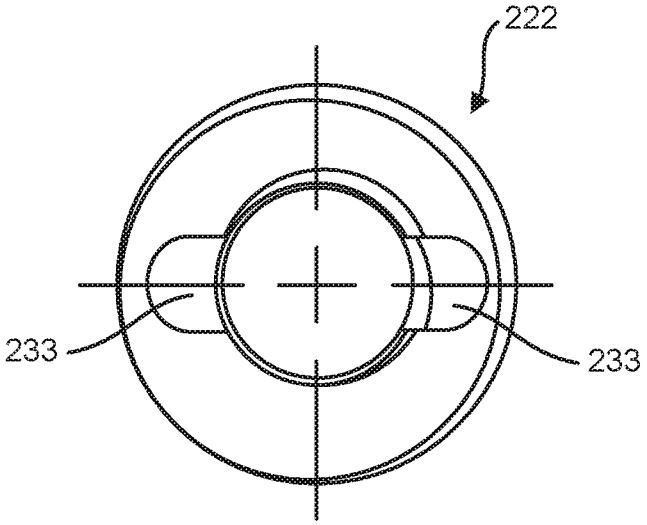
FIG. 11 shows an end view of the drain hole bushing of FIG. 10.
Figure 12:
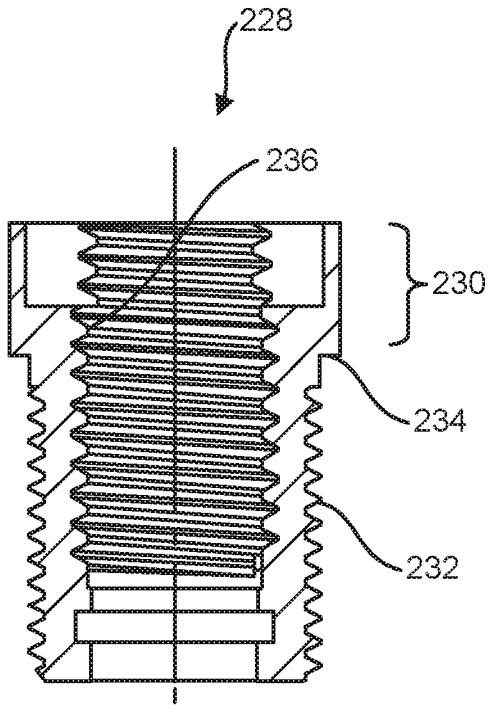
FIG. 12 shows a side view of another embodiment of the drain hole bushing.

The drain hole bushing 222 is shown in greater detail in FIG. 10 and FIG. 11. The drain hole bushing 222 can engage directly with the elbow drain hole 106, such as with external threads 224 that threadingly mate with internal threads 226 of the elbow drain hole 106. The engagement between the elbow drain hole 106 and the drain hole bushing 222 can be sealed to limit or prevent fluid leaking out of the hydrant between the elbow drain hole 106 and the drain hole bushing 222. The seal can include, but is not limited to, thread tape, another sealant, an adhesive, or an epoxy applied to the external threads 224 and/or the internal threads 226, or an O-ring placed between the elbow drain hole 106 and the drain hole bushing 222. For example, an embodiment of FIG. 12 illustrates a location where an O-ring could be positioned. In FIG. 12, a drain hole bushing 228 has a head portion 230 with a larger outer diameter than external threads 232. Between the external threads 232 and the outer diameter of the head portion 230 is a stop surface 234. The elbow drain hole 106 could have a corresponding stop surface (not shown), and an O-ring could be positioned to be compressed between the two stop surfaces. In this embodiment, the internal threads 224 of the elbow drain hole 106 can be repositioned to match the location of the external threads 232. Turning elements 233, which can include slots on an end 235 of the drain hole bushing 222 facilitate rotating of the drain hole bushing 222 to thread the drain hole bushing 222 into or out of the elbow drain hole 106.

Figure 13:
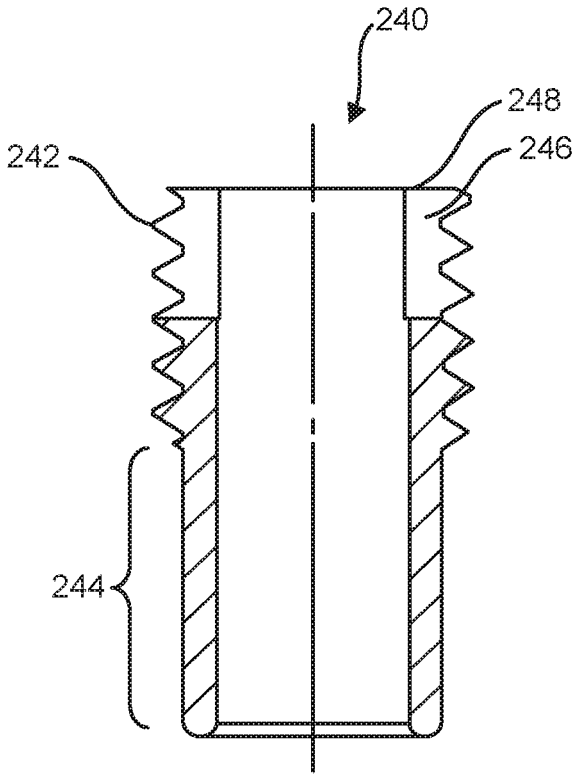
FIG. 13 shows an embodiment of a drain hole sleeve, according to an embodiment.

The drain hole bushing 222 can be permanently installed in the elbow drain hole 106, or at least installed in such a manner that the drain hole bushing 222 would require no regular adjustments but could be removed for maintenance. The hollow drain hole sleeve 240 can be adjustably installed in the drain hole bushing 222, however. FIG. 13 illustrates the adjustable drain hole sleeve 240, which can be hollow to allow flow of fluid therethrough. Referring to FIG. 8-13, the drain hole sleeve 240 can be inserted (e.g., by threading) through the drain hole bushing 222. The drain hole sleeve 240 can have external threads 242 configured to mate with internal threads 236 of the drain hole bushing 222, and can have a non-threaded portion 244 with a smooth and continuous outer surface against which an O-ring can be pressed and rolled. Turning elements 246, which can include slots on an end 248 of the drain hole sleeve 240 facilitate rotating of the drain hole sleeve 240 to thread the drain hole sleeve 240 into or out of the drain hole bushing 222. An O-ring 237 can be positioned in an annular recess or slot 238 in a non-threaded internal surface 239 of the drain hole bushing 222. The O-ring 237 can be compressed between the non-threaded portion 244 of the drain hole sleeve 240 and the annular slot 238 of the drain hole bushing 222 to create a fluid seal between the drain hole sleeve 240 and the drain hole bushing 222 that maintains effectiveness during and after axial adjustment of the drain hole sleeve 240 relative to the drain hole bushing 222.

The drain hole sleeve 240 can be configured to engage directly with the elbow drain hole 106, bypassing any use of the drain hole bushing 222. The drain hole bushing 222, however, can be used to lessen, or keep low, the required level of precision in manufacturing tolerance, and to facilitate better (e.g., more precise and durable) adjustability of the drain hole sleeve 240. The drain hole bushing 222 and the drain hole sleeve 240 can be a relatively durable, hard, corrosion-resistant, precision-tolerance-machinable metal, such as bronze, whereas the elbow 100 and the elbow drain hole 106 can be cast iron with dimensions of relatively low precision. The drain hole bushing 222 can provide a fluid-sealed engagement with the drain hole sleeve 240 and does not require precision adjustability once installed. Once installed, the drain hole bushing 222 need not be adjusted at all unless, for example, maintenance requires the drain hole bushing 222 to be removed or replaced. The engagement between the drain hole bushing 222 and the drain hole sleeve 240 (e.g., bronze on bronze threads), however, allows for precision and repeat adjustability, to allow the drain hole sleeve 240 to be repeatedly and precisely adjusted to seal against the facing 166 of the drain valve body 160.

Figure 14:
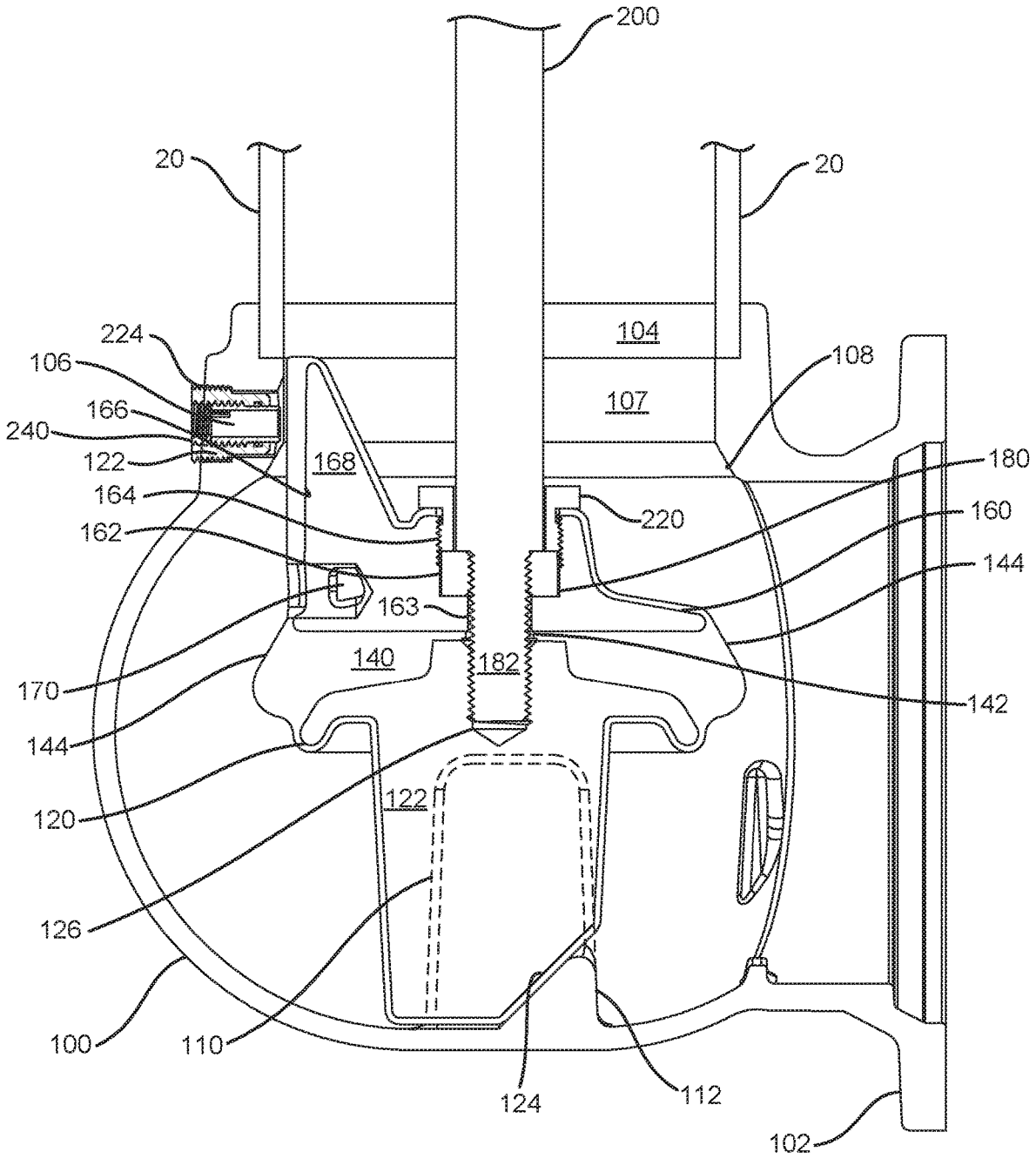
FIG. 14 shows a main valve bottom plate, main valve seal, and drain valve body positioned away from a valve seat in an elbow opening the main valve and closing a drain hole valve.

FIG. 8 and FIG. 14 illustrate the operation of the elbow drain hole 106 and the drain valve body 160. When the main valve is fully opened, as represented in FIG. 14, the angled side 124 of the blade 122 of the bottom plate 120, acting as a first wedge element, meets the opposing second wedge 112 between the two parallel plates 110 at the bottom of the elbow 100 and forming an interior surface of the elbow 100. Downward force imparted by the operating stem extension 200 through the main valve bottom plate 120 onto the blade 122 and blade angled side 124 (a first wedge) can be deflected laterally by the second wedge 112 as the two wedge elements move relative to each other. This lateral force can bias the entire main valve assembly (main valve bottom plate 120, main valve seal 140 and drain valve body 160) toward the elbow drain hole 106 and drain hole sleeve 240. Thus, the drain valve slide 168 and drain valve facing 166 can be brought into positive contact with, and completely cover, the elbow drain hole 106 and drain hole sleeve 240, blocking high pressure water from exiting the elbow 100 when the main valve is opened. If the drain valve facing 166 is not brought into positive contact with, and to completely cover, the elbow drain hole 106 or the drain hole sleeve 240, then the drain hole sleeve 240 can be adjusted easily to obtain the necessary contact, with a necessary amount of force, to limit or prevent any leaking.

Referring to FIG. 8, the main valve can be closed by turning the operating stem nut 60, to raise the main valve assembly (main valve bottom plate 120, main valve seal 140, and drain valve body 160) within the elbow 100 such that the expanded main valve seal surface 144 mates with the valve seat 108 at the lower extent of the elbow 100 channel 107. Positive mating contact, and a tight seal, is provided by the upward lifting force of the operating stem 12 and operating stem extension 200 as the operating nut 60 is turned, as well as through the force of high pressure water in the elbow 100 below the main valve bottom plate 120 forcing the main valve seal 140 and its seal surface 144 upwardly against the valve seat 108.

The blade 122 extending downward from the main valve bottom plate 120 remains between the parallel plates 110 at the bottom of the elbow 100 at all times and prevents rotation of the main valve assembly (main valve bottom plate 120, main valve seal 140 and drain valve body 160) at all times as they are rotationally coupled as described herein. The bonding between the main valve bottom plate 120, the main valve seal 140, and the drain valve body 160, combined with the rotational restraint placed on the main valve assembly by the engagement of the blade 122 and the parallel plates 110 facilitates or ensures that the location of the drain slide 168, the drain valve facing 166, and the drain port 170 remain in functional orientation with the drain hole 106 in the elbow 100 at all times.

Thus, when the main valve assembly is raised to close the main valve, as shown in FIG. 8 and FIG. 9, the drain port 170 can be brought into alignment with the elbow drain hole 106. As high pressure water from the water main is now blocked from entering the lower barrel 20 by the main valve seal 140 and valve seat 108, any water remaining in the lower barrel 20 and upper barrel 10 is now free to flow (see arrows) unimpeded through the drain port 170 (and drain valve facing 166) and elbow drain hole 106 and enter gravel beds, concrete traps, or other drainage facilities.

Construction and installation of the main valve assembly has been described starting with a generally annular cylinder forming the main valve seal 140 first state, and using compression and elastic deformation to squeeze the main valve seal 140 outwardly from the perimeters of the main valve bottom plate 120 and drain valve body 160 into a second state.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A drain valve to drain water from a dry barrel hydrant, the dry barrel hydrant including a barrel coupled to an upper end of an elbow having a hollow body, and a main valve assembly configured to seal against a seat located below a drain hole in the upper end of the elbow, the main valve assembly moving from an open position allowing water to flow from the elbow into the barrel to a closed position in which the main valve assembly seals against the seat, blocking water flow from the elbow into the barrel, the drain valve comprising:

a drain valve body fixed to the main valve assembly, the drain valve body including a drain valve facing configured to align with the drain hole of the elbow as a result of the main valve assembly being in the open position, and to not align with the drain hole of the elbow as a result of the main valve assembly being in the closed position;

a drain hole sleeve positioned in the drain hole of the elbow, the drain hole sleeve being hollow; and a drain hole bushing positioned in the drain hole of the elbow, the drain hole bushing being hollow, the drain hole sleeve being positioned in the drain hole bushing adjustably relative to the drain hole bushing.

2. The drain valve of claim 1, wherein the drain hole sleeve is adjustable axially in the drain hole.

3. The drain valve of claim 1, wherein the drain hole of the elbow includes internal threads, the drain hole bushing includes external threads to threadingly mate with the internal threads of the drain hole of the elbow, the drain hole bushing includes internal threads, and the drain hole sleeve includes external threads to threadingly mate with the internal threads of the drain hole bushing.

4. The drain valve of claim 1, wherein the drain hole bushing includes a stop surface created by a step from a first outer diameter to a second outer diameter larger than the first outer diameter, and the step of the drain hole bushing is configured to abut a step of the drain hole of the elbow as a result of full insertion of the drain hole bushing into the drain hole of the elbow.

5. The drain valve of claim 1, wherein the drain hole sleeve includes a non-threaded exterior portion, the drain hole bushing includes an annular slot on a radially inward facing surface.

6. The drain valve of claim 5, further comprising an O-ring in the annular slot, between the drain hole bushing and the non-threaded exterior portion of the drain hole sleeve.

7. The drain valve of claim 1, wherein a hollow of the drain hole sleeve has a diameter and an outer wall of the drain hole sleeve defining the hollow has a wall thickness, the diameter greater than the wall thickness.

8. An elbow of a fire hydrant, the elbow comprising:

a hollow body;

an upper end defining a drain hole to allow water to drain out;

a drain hole bushing positioned in the drain hole, the drain hole bushing being hollow, a drain hole sleeve positioned in the drain hole bushing, the drain hole sleeve being adjustable relative to the drain hole bushing.

9. The elbow of claim 8, wherein a hollow of the drain hole sleeve has a diameter and an outer wall of the drain hole sleeve defining the hollow has a wall thickness, the diameter greater than the wall thickness.

10. The elbow of claim 8, wherein the drain hole sleeve is adjustable axially in the drain hole.

11. The elbow of claim 8, wherein the drain hole includes internal threads, the drain hole bushing includes external threads to threadingly mate with the internal threads of the drain hole, the drain hole bushing includes internal threads, and the drain hole sleeve includes external threads to threadingly mate with the internal threads of the drain hole bushing.

12. The elbow of claim 8, wherein the drain hole bushing includes a stop surface created by a step from a first outer diameter to a second outer diameter larger than the first outer diameter, and the step of the drain hole bushing is configured to abut a step of the drain hole as a result of full insertion of the drain hole bushing into the drain hole.

13. The elbow of claim 8, wherein the drain hole sleeve includes a non-threaded exterior portion, the drain hole bushing includes an annular slot on a radially inward facing surface.

14. The elbow of claim 13, further comprising an O-ring in the annular slot, between the drain hole bushing and the non-threaded exterior portion of the drain hole sleeve.

15. A drain valve to drain water from a dry barrel hydrant, the dry barrel hydrant including a barrel coupled to an upper end of an elbow having a hollow body, and a main valve assembly configured to seal against a seat located below a drain hole in the upper end of the elbow, the main valve assembly moving from an open position allowing water to flow from the elbow into the barrel to a closed position in which the main valve assembly seals against the seat, blocking water flow from the elbow into the barrel, the drain valve comprising:

a drain valve body fixed to the main valve assembly, the drain valve body including a drain valve facing configured to align with the drain hole of the elbow as a result of the main valve assembly being in the open position, and to not align with the drain hole of the elbow as a result of the main valve assembly being in the closed position; and a drain hole sleeve positioned in the drain hole of the elbow, the drain hole sleeve being hollow, having an external circumference, and being adjustable axially in the drain hole, the drain hole sleeve configured to be sealed around the external circumference in a plurality of axially adjusted positions of the drain hole sleeve.

16. A drain valve to drain water from a dry barrel hydrant, the dry barrel hydrant including a barrel coupled to an upper end of an elbow having a hollow body, and a main valve assembly configured to seal against a seat located below a drain hole in the upper end of the elbow, the main valve assembly moving from an open position allowing water to flow from the elbow into the barrel to a closed position in which the main valve assembly seals against the seat, blocking water flow from the elbow into the barrel, the drain valve comprising:

a drain valve body fixed to the main valve assembly, the drain valve body including a drain valve facing configured to align with the drain hole of the elbow as a result of the main valve assembly being in the open position, and to not align with the drain hole of the elbow as a result of the main valve assembly being in the closed position;

a drain hole sleeve positioned in the drain hole of the elbow, the drain hole sleeve being hollow and having a circumference; and an o-ring extending around the circumference.

17. An elbow of a fire hydrant, the elbow comprising:

a hollow body;

an upper end defining a drain hole to allow water to drain out;

a drain hole sleeve in the drain hole, the drain hole sleeve being hollow, having an external circumference, and being adjustable axially in the drain hole, the drain hole sleeve configured to be sealed around the external circumference in a plurality of axially adjusted positions of the drain hole sleeve.

18. An elbow of a fire hydrant, the elbow comprising:

a hollow body;

an upper end defining a drain hole to allow water to drain out;

a drain hole sleeve in the drain hole, the drain hole sleeve being hollow and having a circumference; and an o-ring extending around the circumference.

* * * * *